US006935267B1

(12) United States Patent
Cotton

(10) Patent No.: US 6,935,267 B1
(45) Date of Patent: Aug. 30, 2005

(54) VENTED FUEL FILLER AND METHOD OF INSTALLATION

(76) Inventor: Oren Cotton, P.O. Box 729, East Sound, WA (US) 98245

( * ) Notice: Subject to any disclaimer, the term of this patent is extended or adjusted under 35 U.S.C. 154(b) by 0 days.

(21) Appl. No.: 10/974,905

(22) Filed: Oct. 27, 2004

(51) Int. Cl.[7] ..... B63B 17/00
(52) U.S. Cl. ..... 114/364
(58) Field of Search ..... 114/343, 364

(56) References Cited

U.S. PATENT DOCUMENTS 4,660,266 A * 4/1987 Horn ..... 29/417
4,724,861 A 2/1988 Covert et al.
4,747,508 A 5/1988 Sherwood
4,765,504 A 8/1988 Sherwood et al.
4,874,020 A 10/1989 Bucci
4,877,146 A 10/1989 Harris
5,033,517 A 7/1991 Bucci
5,275,213 A 1/1994 Perkins
5,375,633 A 12/1994 Bucci
5,507,324 A 4/1996 Whitley
5,996,622 A 12/1999 Cimminelli et al.
6,026,521 A * 2/2000 Atkins ..... 4/252.4
6,155,743 A * 12/2000 Chen ..... 403/374.1
6,237,645 B1 5/2001 Pountney
6,286,192 B2 * 9/2001 Pfister ..... 24/514
6,325,240 B1 12/2001 Gruber
6,666,238 B1 12/2003 Crowley et al.

* cited by examiner

*Primary Examiner*—Stephen Avila
(74) *Attorney, Agent, or Firm*—Andrew W. Ludy

(57) ABSTRACT

A vented fuel filler is installed in a boat from below the deck. The vented fuel filler comprises a body with an inlet portion. First and second grooves extend in arcs across the outer surface of the inlet portion upper end. Fuel and vent nozzles communicate with the inlet portion and the fuel tank. First and second clamps extend in arcs between opposite ends. The body inlet portion is inserted in a single, circular deck hole from below. The clamp inner edges are inserted into the body first and second grooves, and then the clamps are fastened to the deck. A cap has an annular array of teeth facing inward. A threaded insert has an annular array of teeth projecting outward. The insert teeth are received in the cap teeth, so that the cap can be selectively rotated. An inscription of "gas" will then be readable from the fuel dock by a dock attendant.

12 Claims, 9 Drawing Sheets

VENTED FUEL FILLER AND METHOD OF INSTALLATION

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

This invention relates to the field of fuel fillers, and more particularly, to a vented fuel filler for a boat and a method of installing the filler in the boat. Powerboats and sailboats with auxiliary engines have fuel tanks mounted low in the hull, and connected by a hose or pipe to a filler mounted on deck. The fuel tank must be vented, so that as fuel enters the tank, air in the tank is displaced and exits the vent. The vent hose is connected back to the filler, because as fuel nears the top of the tank, it surges up the vent hose. For environmental reasons, this fuel surge is best directed back to the tank, rather than discharged overboard. The filler has a cap, which is vented to atmosphere, so that as fuel is consumed, air is slowly admitted to the tank to displace the used fuel. The fuel cap has the word "gas" or "diesel" inscribed upon it, so as to distinguish the fuel fill from the water fill, which is similar in appearance. The inscription is best positioned so that it faces the outboard side of the boat, and can be read from the fuel dock by an attendant.

The filler is usually mounted on a side deck at the gunwale of the boat. Boats are typically manufactured with the hull separate from the deck and the cabin sole and cockpit sole. The fuel tank is installed in the bare hull first, and then the cabin sole is installed. Then the deck is added, and attached to the hull around the gunwale. If the fuel tank were found to be leaking at this time, the structure would have to be cut apart to repair the tank. For this reason, the entire fuel supply system, including the tank, is tested before the deck is installed. The test, required by the Coast Guard, involves sealing and pressurizing the fuel system to three pounds per square inch for thirty minutes. If the pressure drops during this period, it indicates a leak in the fuel tank, or a loose fitting or hose. Thus, it would be best to install the filler on the fuel and vent hoses for the test, and not remove or disturb the connections. However, current practice is to remove the filler, install the deck, and reinstall the filler, then re-test.

The fuel filler should be mounted low to the deck, almost flush, for appearance, and to reduce the trip hazard for anyone walking on deck. The filler must be mounted in a stable position, unable to move upward or downward, nor able to rotate. Vented fuel fillers typically have a large flange around the filler top for mounting the filler on the deck. The flange requires that the filler be installed from the above the deck. The vent attachment to the side of the main body necessitates a keyhole-shaped hole be made in the deck to install the filler. Such a hole is problematic and time-consuming to cut. The tank and vent hoses must then be connected from beneath the deck, in close quarters. Wielding tools in these close spaces is difficult. It would be advantageous to be able to cut only one round hole in the deck, and to install the filler from below without removing the hose connections.

Fuel fill devices for boats are known, and have taken a variety of configurations in the past. Some fuel fillers in the prior art are shown in the following patents:

Bucci, U.S. Pat. No. 5,375,663, and Whitley, U.S. Pat. No. 5,507,324, each has a vented filler with a large flange. These fillers must be installed from above through a keyhole-shaped hole.

Pountney, U.S. Pat. No. 6,237,645, discloses a filler that is not vented. The tank vent is separate, and requires a separate gas can with a special connector to catch the fuel surge overflow. While this filler can be installed from below through a round hole, it requires a second deck hole and fitting for the vented overflow.

Crowley, U.S. Pat. No. 6,666,238, shows a split collar for a fuel filler pipe. This collar is intended for connecting two rigid pipes together. It cannot be used to mount a filler on a boat deck. It has no structure to hold the filler from moving upward or downward, or to prevent rotation in the deck hole. The collar is too high, and would pose a trip hazard. There are no holes for fasteners, nor room for any.

Accordingly, there is a need to provide a vented fuel filler for a boat that can be installed from below the deck.

There is a further need to provide a vented fuel filler of the type described and that will permit pressure testing and subsequent installation without removing the hose connections.

There is a yet further need to provide a vented fuel filler of the type described and that requires only one round hole in the deck, not multiple holes or keyholes.

There is a still further need to provide a vented fuel filler of the type described and that has a vented cap, which will allow rotational adjustment of the cap so that inscriptions can be read from the fuel dock.

There is another need to provide a vented fuel filler of the type described and that can be manufactured cost-effectively in large quantities of high quality.

BRIEF SUMMARY OF THE INVENTION

In accordance with the present invention, there is provided a vented fuel filler for a boat having a hull and a deck with a single round hole to receive the filler. The boat has a fuel tank, a fuel tank fill hose communicating with the fuel tank, and a fuel tank vent hose communicating with the fuel tank. The vented fuel filler comprises a body with an inlet portion. The inlet portion is a hollow cylinder extending between opposite upper and lower ends. The inlet portion has inner and outer surfaces, and first and second grooves in the outer surface adjacent the upper end. Each one of the first and second grooves extends in an arc between opposite ends. The inlet portion has threads at the upper end. The body has a fuel nozzle attached to the inlet portion lower end. The fuel nozzle is adapted for connection to the fuel tank fill hose. The body has a vent nozzle attached to the inlet portion adjacent the lower end. The vent nozzle is adapted for connection to the fuel tank vent hose. The inlet portion communicates with the fuel nozzle and the vent nozzle.

A cover is provided, having a cap. The cap has a roof with a periphery, a top surface, and a bottom surface. The cap has a skirt extending outward from the roof periphery. The cap has a boss centered on the roof bottom surface and extending downward from it. The cap has a plurality of teeth arranged annularly on the roof bottom surface, and facing inward. The cover has an insert with a generally circular plate. The plate has a periphery, a top surface and a bottom surface. The plate has at least one vent hole through it for venting air. The insert has an annular wall extending downward from the plate bottom surface. The wall has threads adapted to engage the body inlet portion threads. The insert has a boss extending downward from the plate bottom surface. The boss has a hole through it adapted to receive the cap boss. The insert has a plurality of teeth projecting outward from the plate periphery. The insert teeth are adapted to be selectively received in the cap teeth, so that the cap is selectively angularly positioned on the insert. The plate has at least one knob projecting upward from the plate top surface. The cover has attaching means for attaching the insert to the cap. Thus, upon assembly of the insert into the cap, the insert teeth will be received in the cap teeth, the cap boss will be received in the insert boss hole, and the knob will provide a space between the cap roof bottom surface and the insert plate top surface. In this manner, vent air will be allowed to flow around the teeth, across the plate top surface, and through the plate vent hole. Sealing means is provided for releasably sealing the cover to the body.

A first clamp and a second clamp are provided. Each one of the first and second clamps extends in an arc between opposite ends. Each one of the first and second clamps has semicircular inner and outer edges, and at least one fastener hole through it. The first and second clamp inner edges are adapted to engage the body first and second grooves respectively. Thus, upon assembly of the vented fuel filler into the deck, the body inlet portion will be inserted in the deck hole from below, the first and second clamp inner edges will be inserted into the body first and second grooves respectively, and the first and second clamps will be fastened to the deck. With the present invention, the vented fuel filler will be installed in the boat from below the deck.

BRIEF DESCRIPTION OF THE SEVERAL VIEWS OF THE DRAWING

The invention will be more fully understood, while still further objects and advantages will become apparent, in the following detailed description of preferred embodiments thereof illustrated in the accompanying drawing, in which.

DETAILED DESCRIPTION OF THE INVENTION

Figure 1:
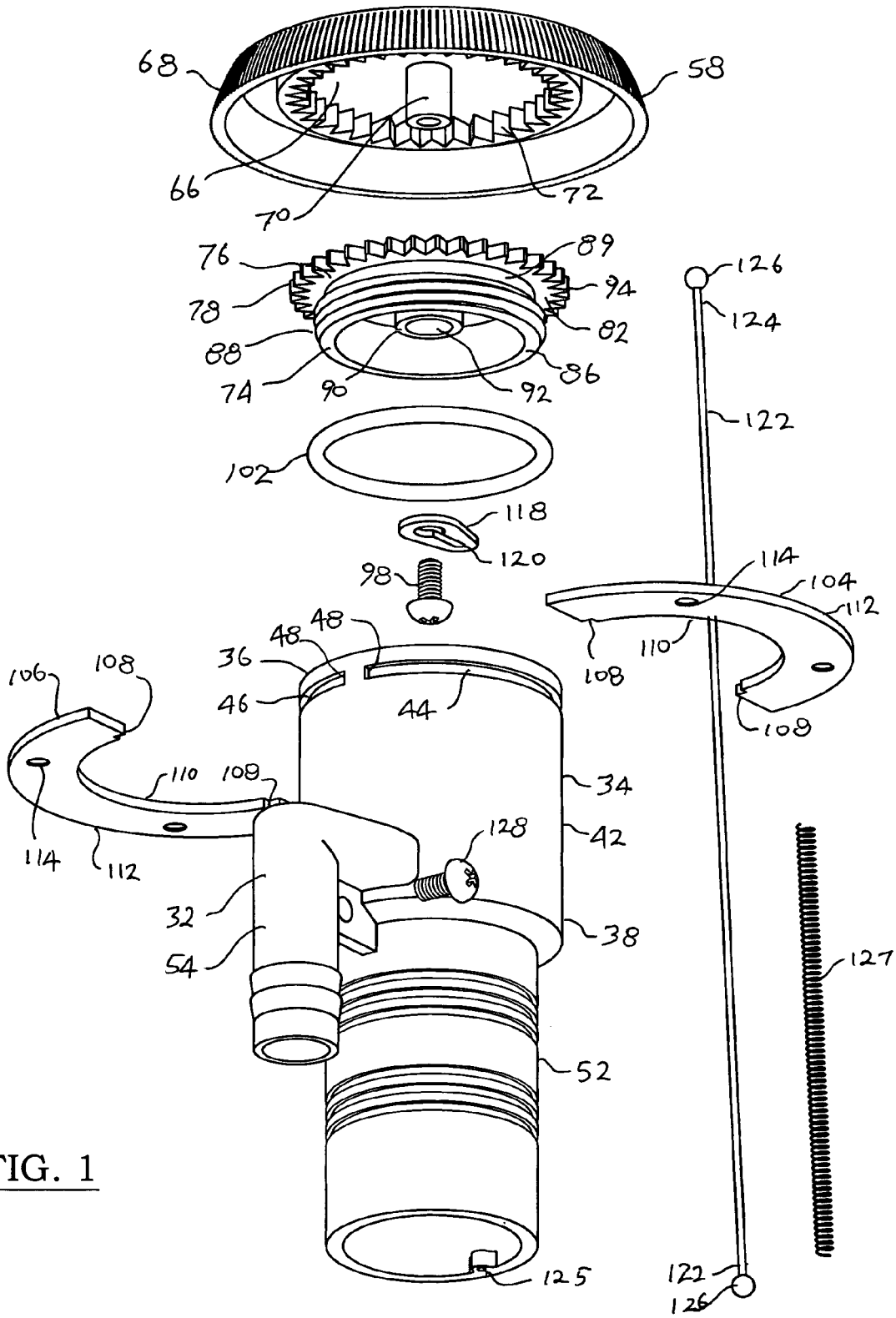
FIG. 1 is an exploded, assembly, perspective view of a vented fuel filler constructed in accordance with the invention.
Figure 2:
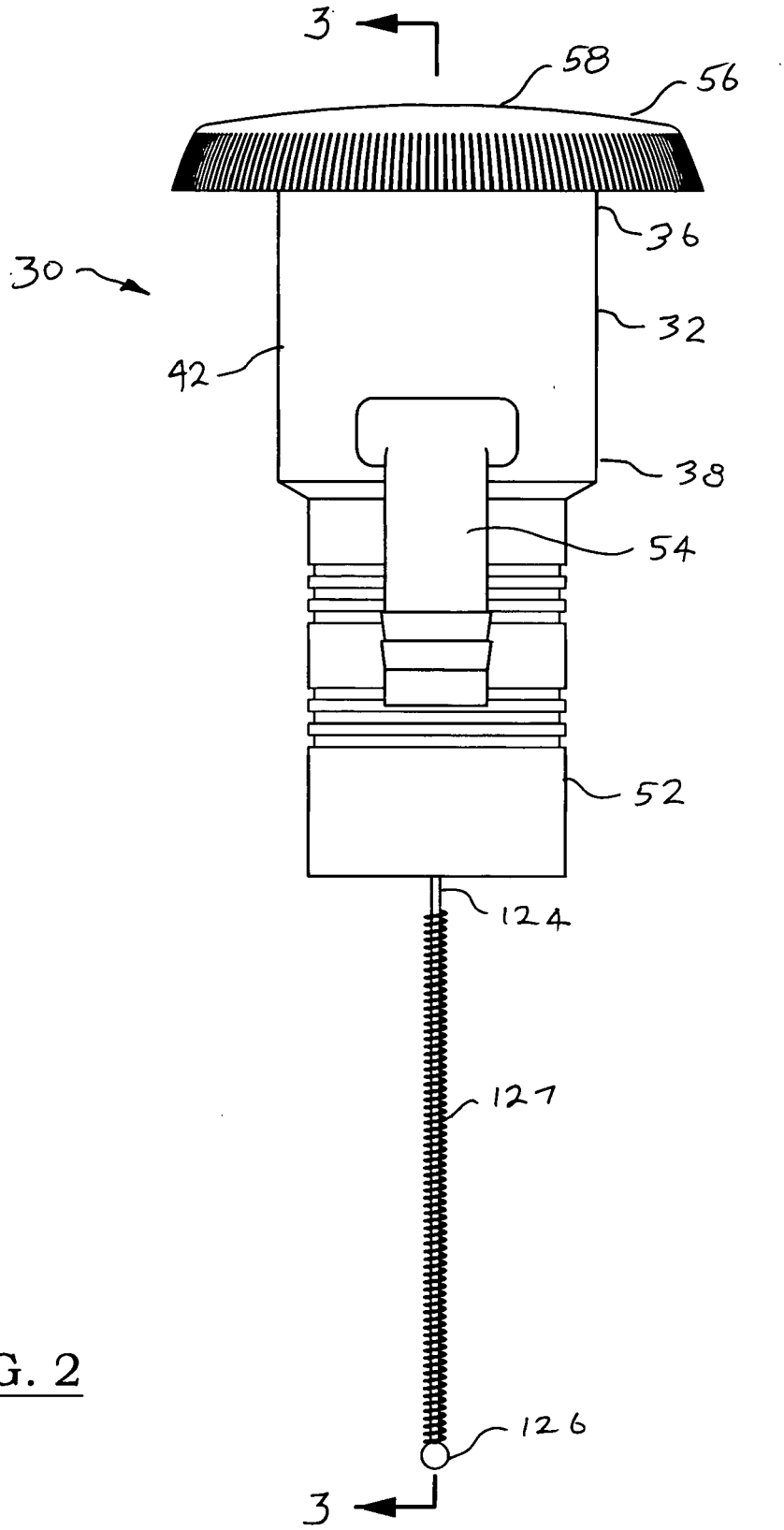
FIG. 2 is a front elevational view of the vented fuel filler of FIG. 1.
Figure 3:
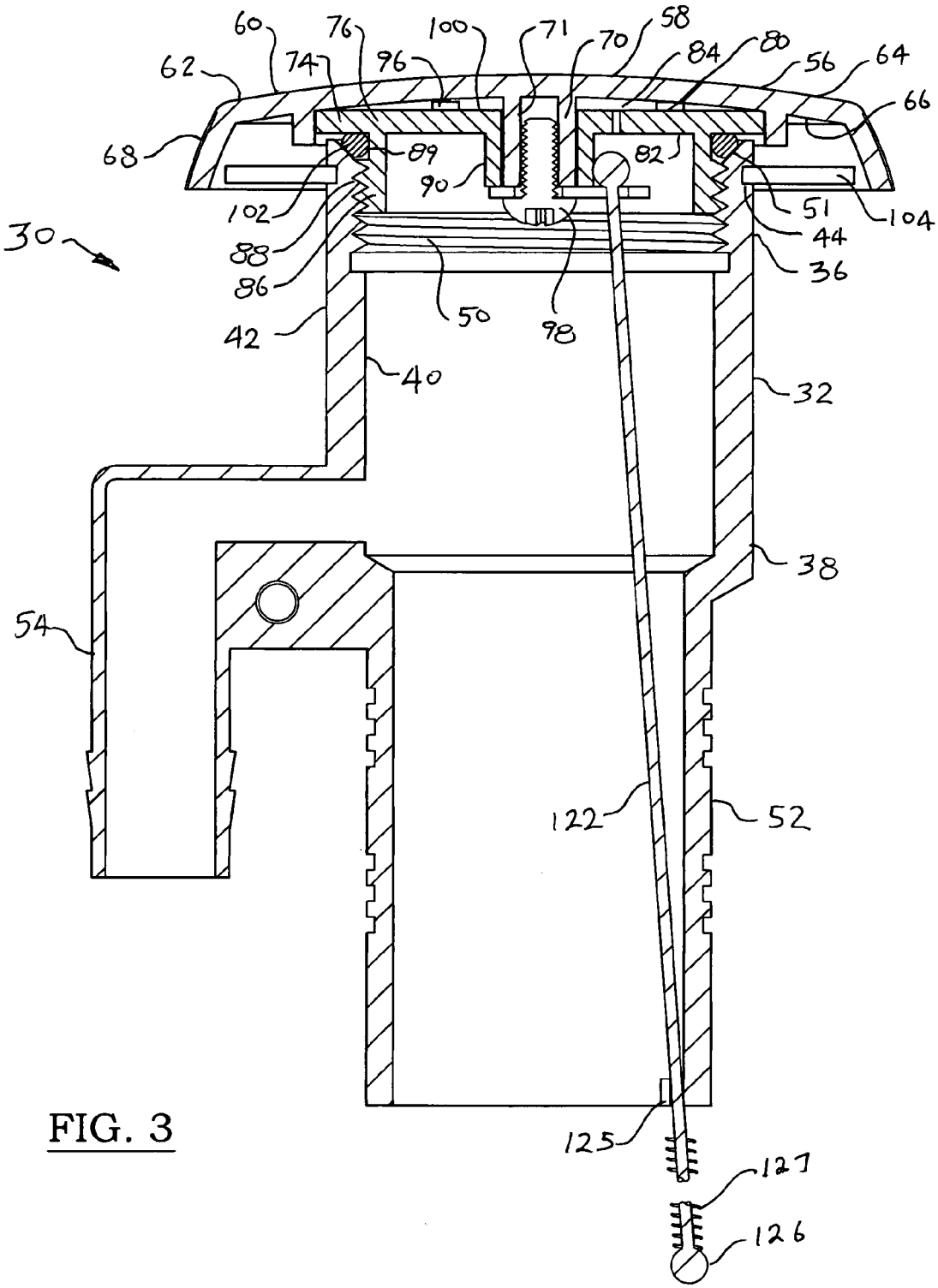
FIG. 3 is a right side sectional elevational view of the vented fuel filler of FIG. 1.
Figure 4:
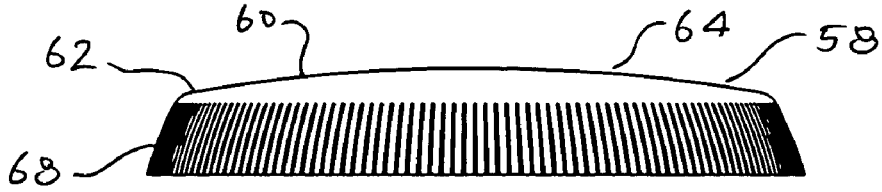
FIG. 4 is a front elevational view of a cap used with the vented fuel filler of FIG. 1.
Figure 5:
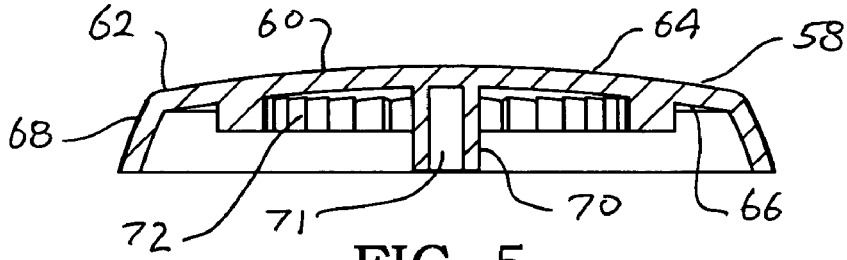
FIG. 5 is a front elevational sectional view of the cap of FIG. 4, taken along lines 5—5 of FIG. 6.
Figure 6:
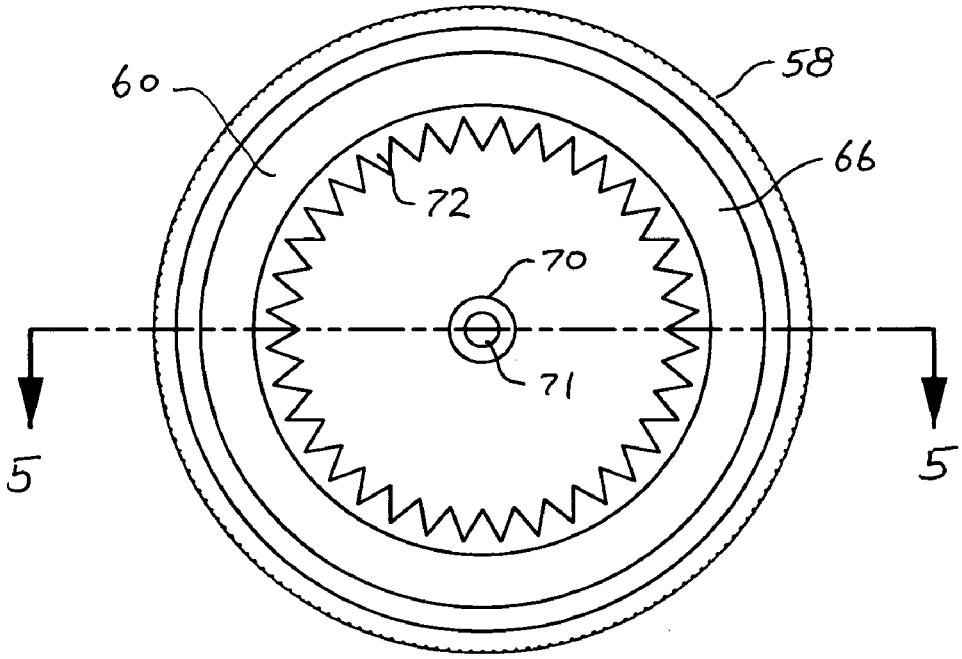
FIG. 6 is a bottom plan view of the cap of FIG. 4.
Figure 7:
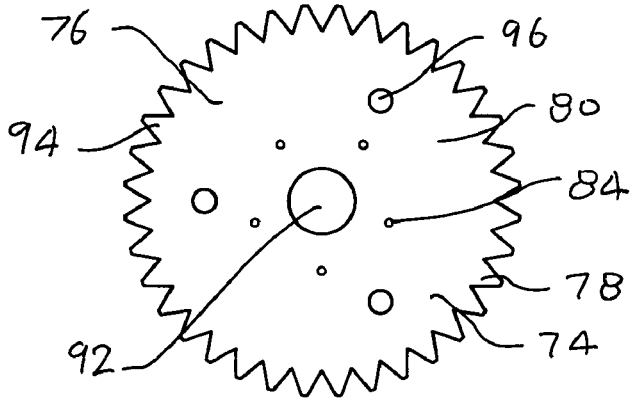
FIG. 7 is a top plan view of a threaded insert used with the cap of FIG. 4.
Figure 8:
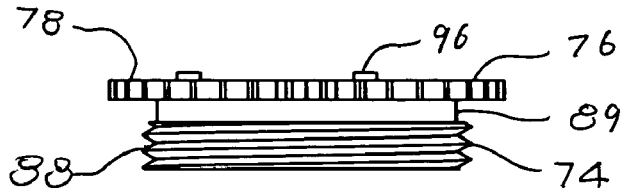
FIG. 8 is a side elevational view of the threaded insert of FIG. 7.
Figure 9:
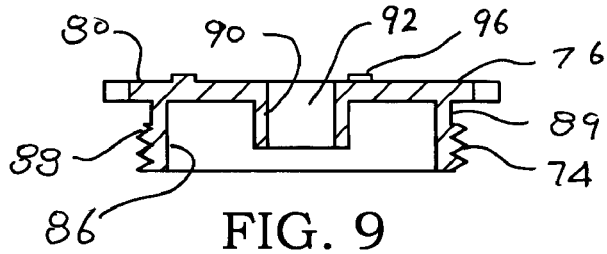
FIG. 9 is a side elevational sectional view of the threaded insert of FIG. 7, taken along lines 9—9 of FIG. 10.
Figure 10:
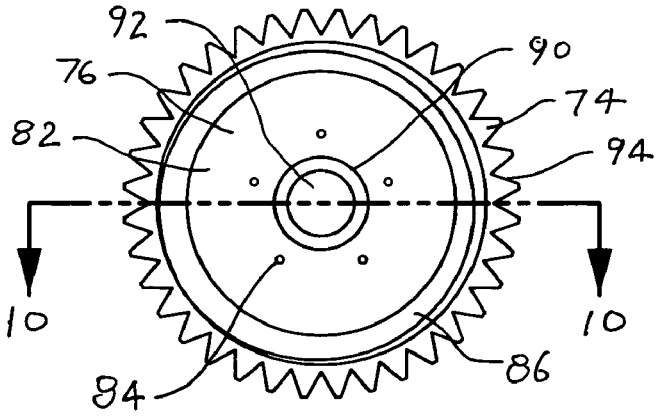
FIG. 10 is a bottom plan view of the threaded insert of FIG. 7.

Referring now to the drawing, a vented fuel filler is shown at 30, and is for use in connection with a boat 18 having a hull 20 and a deck 22 with a single round hole 24 to receive the filler 30. The boat 18 has a fuel tank (not shown), a fuel tank fill hose 26 communicating with the fuel tank, and a fuel tank vent hose 28 communicating with the fuel tank. The vented fuel filler 30 comprises a body 32 with an inlet portion 34. The inlet portion 34 is a hollow cylinder extending between opposite upper 36 and lower 38 ends. The inlet portion 34 has inner 40 and outer 42 surfaces, and first 44 and second 46 grooves in the outer surface 42 adjacent the upper end 36. Each one of the first 44 and second 46 grooves extends in an arc between opposite ends 48. The inlet portion 34 has threads 50 at the upper end 36. The inlet portion inner surface 40 includes an O-ring seat 51 at the upper end 36. The body 32 has a fuel nozzle 52 attached to the inlet portion lower end 38. The fuel nozzle 52 is adapted for connection to the fuel tank fill hose 26. The body has a vent nozzle 54 attached to the inlet portion 34 adjacent the lower end 38. The vent nozzle 54 is adapted for connection to the fuel tank vent hose 28. The inlet portion 34 communicates with the fuel nozzle 52 and the vent nozzle 54. During fuel filling, fuel will enter the inlet portion 34, and pass through the fuel nozzle 52, through the fuel tank fill hose 26, and into the fuel tank. In the event that the fuel should surge up the fuel tank vent hose 28, the vent nozzle 54 will direct the overflow back into the fuel tank. The body 32 preferably will be fabricated from stainless steel, or molded from a polymeric resin. Other materials, such as brass, bronze, or monel, can be substituted.

A cover 56 is provided, having a cap 58. The cap 58 has a roof 60 with a periphery 62, a top surface 64, and a bottom surface 66. The cap 58 has a skirt 68 extending outward from the roof periphery 62. The cap 58 has an inscription 130 on the roof top surface 64 indicating the fuel type. The cap 58 has a boss 70 centered on the roof bottom surface 66 and extending downward from it. The cap boss 70 includes a threaded hole 71 centered therein. The cap 58 has a plurality of teeth 72 arranged annularly on the roof bottom surface 66, and facing inward. The cap 58 is typically made from stainless steel, although a variety of materials could be utilized. The cover 56 has an insert 74 with a generally circular plate 76. The plate 76 has a periphery 78, a top surface 80 and a bottom surface 82. The plate 76 has at least one vent hole 84 through it for venting air. The insert 74 has an annular wall 86 extending downward from the plate bottom surface 82. The wall 86 has threads 88 adapted to engage the body inlet portion threads 50. The insert 74 includes an O-ring groove 89 between the insert wall threads 88 and the insert plate bottom surface 82. The insert 74 has a boss 90 extending downward from the plate bottom surface 82. The boss 90 has a hole 92 through it adapted to receive the cap boss 70. The insert 74 has a plurality of teeth 94 projecting outward from the plate periphery 78. The insert teeth 94 are adapted to be selectively received in the cap teeth 74, so that the cap 58 is selectively angularly positioned on the insert 74. The plate 76 has at least one knob 96 projecting upward from the plate top surface 80. The insert 74 is preferably molded from a polymeric resin, although other materials could be substituted. The cover 56 has attaching means for attaching the insert 74 to the cap 58. Specifically, the attaching means includes an attaching screw 98 received in the cap boss threaded hole 71. Thus, upon assembly of the insert 74 into the cap 58, the insert teeth 94 will be received in the cap teeth 74, the cap boss 70 will be received in the insert boss hole 92, and the knob 96 will provide a space 100 between the cap roof bottom surface 66 and the insert plate top surface 80. In this manner, vent air will be allowed to flow around the insert teeth 94, across the plate top surface 80, and through the plate vent hole 84. The air is then allowed to pass through the body 32, through the fuel tank fill hose 26, and enter the fuel tank to displace fuel being consumed. Sealing means is provided for releasably sealing the cover to the body. Specifically, the sealing means includes an O-ring 102 received in the O-ring groove 89.

A first clamp 104 and a second clamp 106 are provided. Each one of the first 104 and second 106 clamps extends in an arc between opposite ends 108. Each one of the first 104 and second 106 clamps has semicircular inner 110 and outer 112 edges, and at least one fastener hole 114 through it. The first 104 and second 106 clamp inner edges 110 are adapted to engage the body first 44 and second 46 grooves respectively. A gasket 116 is interposed between the first 104 and second 106 clamps and the deck 22, so as to seal the deck hole 24 against water intrusion.

Figure 11:
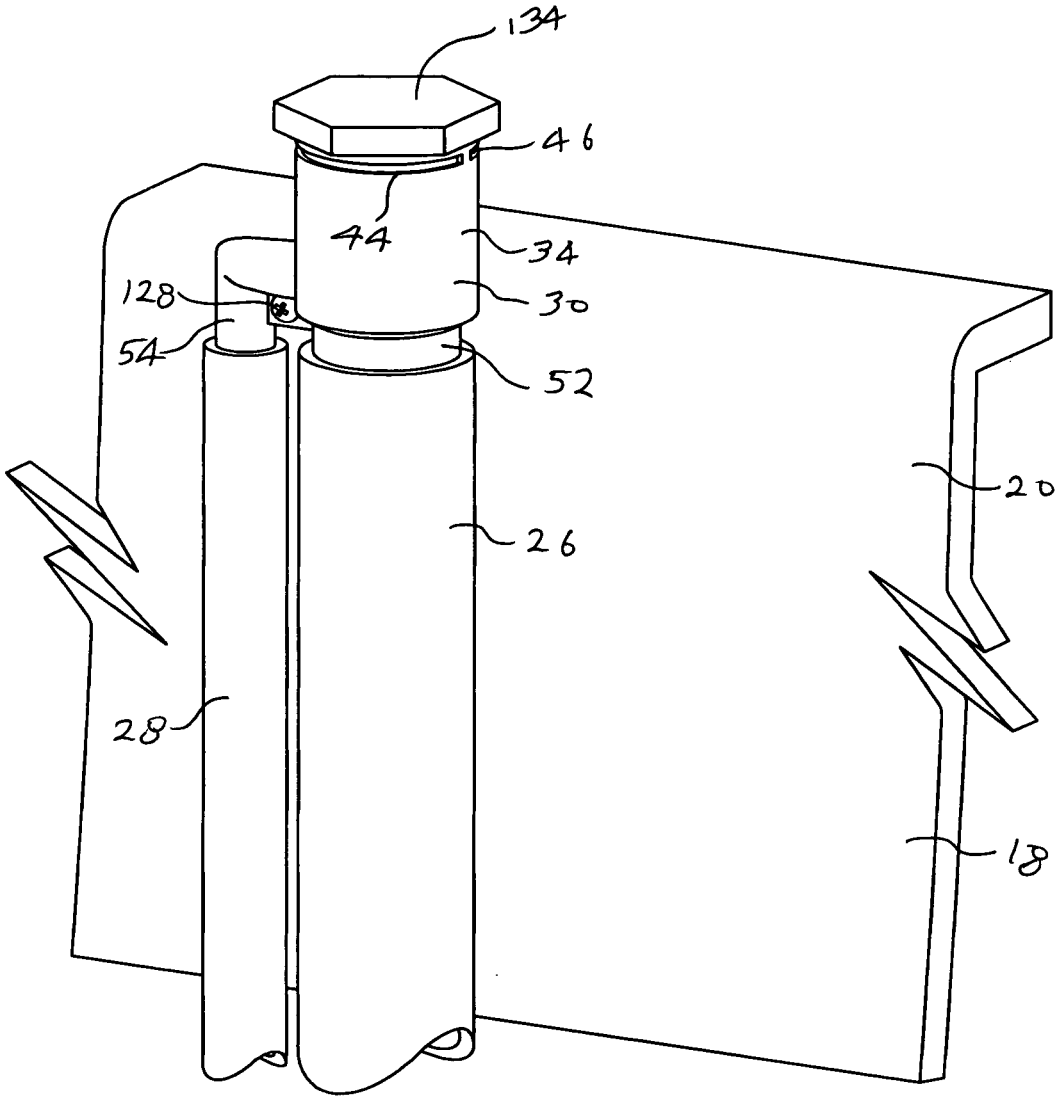
FIG. 11 is a perspective assembly view of the vented fuel filler of FIG. 1, showing the pressure test mode before installing the deck.
Figure 12:
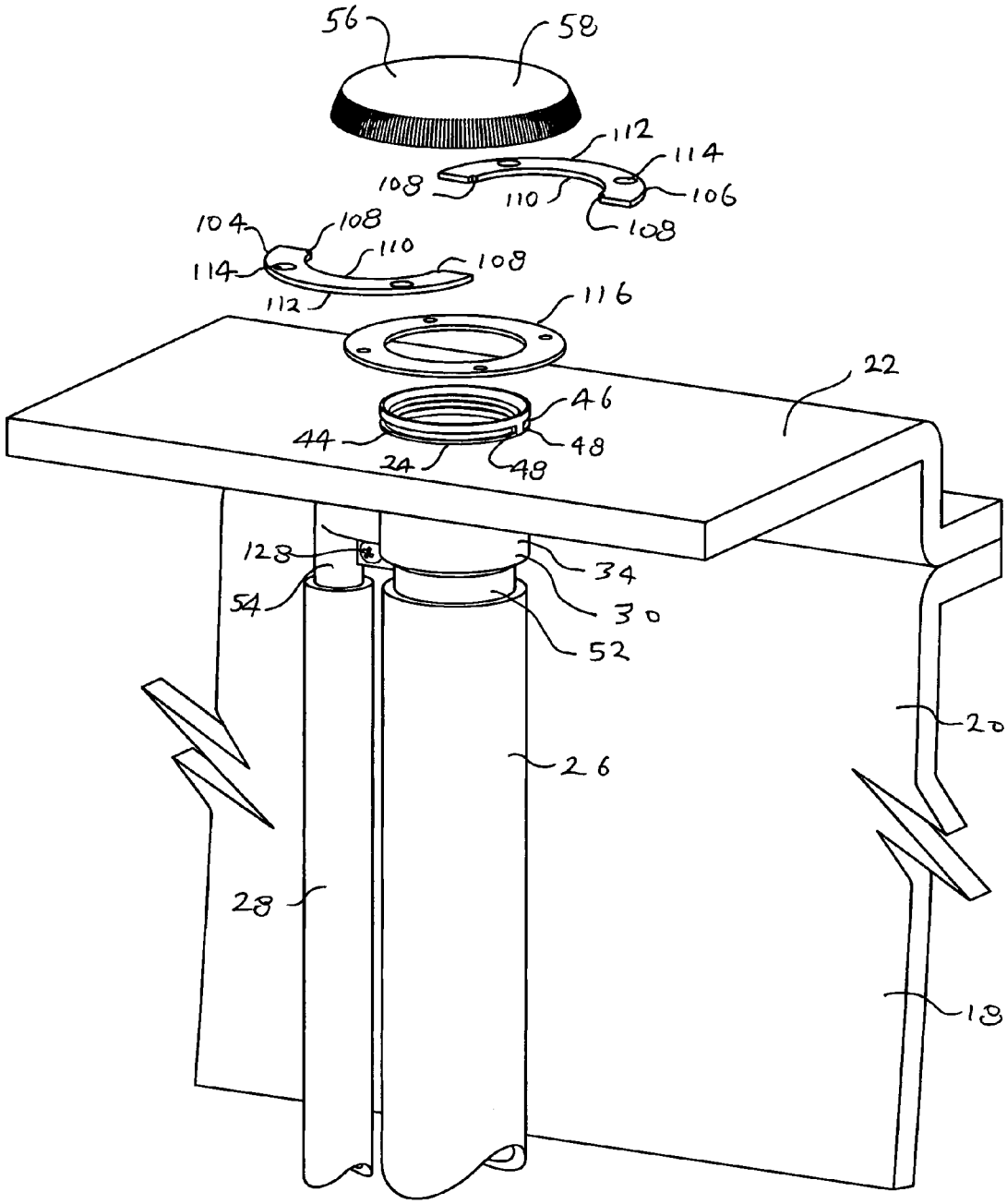
FIG. 12 is an exploded perspective assembly view of the vented fuel filler of FIG. 1, showing installation of the filler in the deck.
Figure 13:
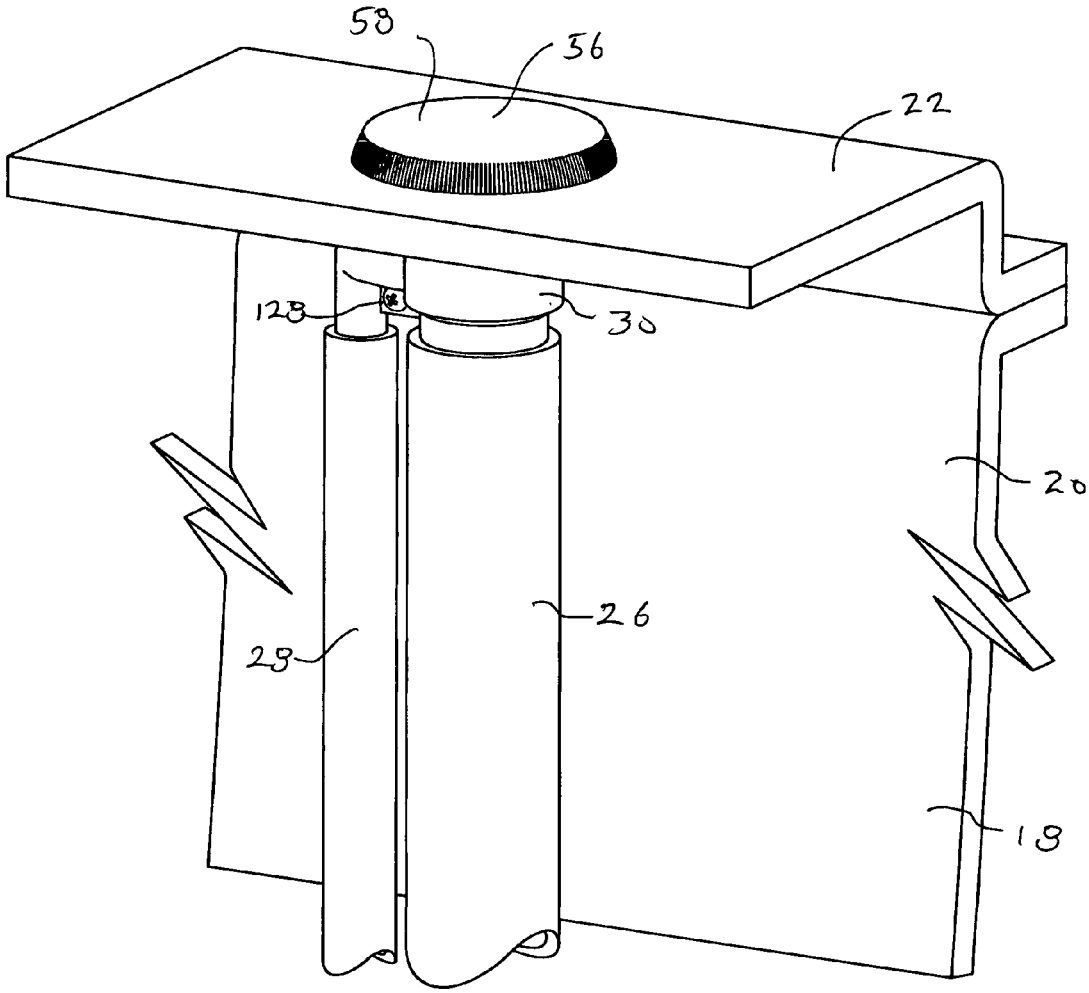
FIG. 13 is a perspective assembly view of the vented fuel filler of FIG. 1, showing installation of the filler in the deck.

A link 118 is provided, having a keyhole-shaped slot 120 through it. The link 118 is mounted on the cap boss 70 with the attaching screw 98 passing through the slot 120. A safety wire 122 extends between opposite ends 124. The safety wire 122 prevents loss of the cover 56 overboard. The safety wire 122 has a ferrule 126 attached to each end 124. One end 124 of the safety wire 122 passes through the link slot 120. The opposite end 124 of the safety wire 122 is slideably attached to the body 32 at an attachment point 125. A spring 127 is attached to the safety wire 122 for retracting the safety wire 122 when the cover 56 is installed on the body 32. A grounding screw 128 is threadably attached to the body 32 to connect a wire (not shown) for electrically grounding the vented fuel filler 30 to an engine system ground (not shown). A non-vented test cap 134 is used during the pressure test described above, and then it is removed. FIG. 11 shows the vented fuel filler 30 with the test cap 134, installed on the fuel tank fill hose 26, and the fuel tank vent hose 28, before the deck 22 is installed on the hull 20.

Figure 14:
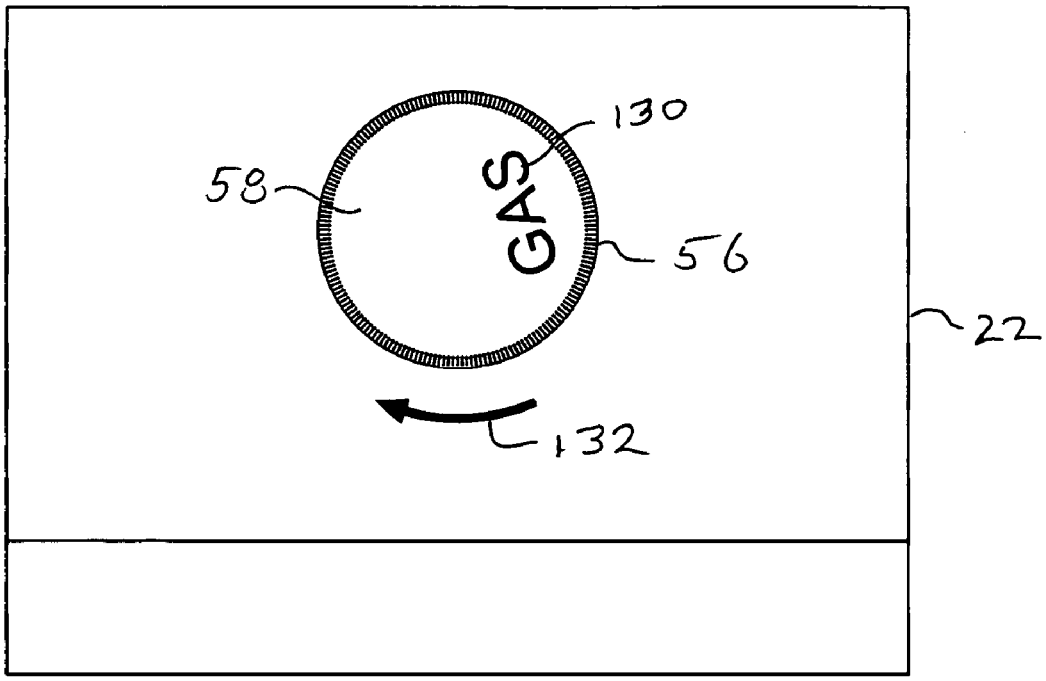
FIG. 14 is a top plan view of the vented fuel filler of FIG. 1, showing filler cap rotation.
Figure 15:
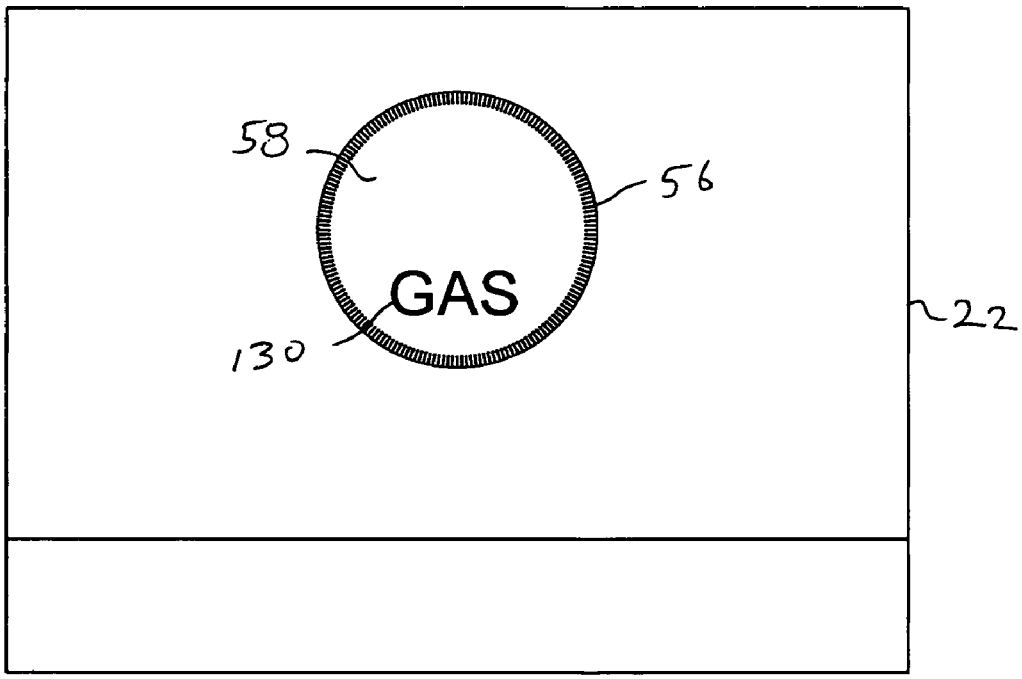
FIG. 15 is a top plan view of the vented fuel filler of FIG. 1.

Thus, upon assembly of the vented fuel filler 30 into the deck 22, the body inlet portion 34 will be inserted in the deck hole 24 from below, the first 104 and second 106 clamp inner edges 110 will be inserted into the body first 44 and second 46 grooves respectively, and the first 104 and second 106 clamps will be fastened to the deck 22. The cover 56 with the insert 74 is then threaded into the upper end 36 of the inlet portion 34, thereby covering the vented fuel filler 30. With the present invention, the vented fuel filler 30 will be installed in the boat 18 from below the deck 22. Another advantage of the present invention is the ability to adjust the angular positioning of the cap on the insert selectively, as shown in FIGS. 14 and 15. The attaching screw 98 is removed, the cap 58 is lifted off the insert 74, disengaging the cap teeth 72 from the insert teeth 94. The cap 58 is then selectively rotated as shown by arrow 132, and the cover 56 is reassembled. The inscription will then be readable from a predetermined position on the fuel dock by a dock attendant. The present invention, the vented fuel filler 30, is described as being used for gasoline or diesel fuel, wherein the inscription on the cover will read, "gas," or "diesel." It is to be understood, however, that the present invention can be used just as effectively for admitting water to a water tank aboard the boat. The inscription on the cover will then read, "water."

An installing method is also disclosed for installing a vented fuel filler 30 in a boat deck 22 from below the deck. The method comprises the steps of providing a vented fuel filler 30 with an inlet portion 34 of a predetermined diameter, then extending a fuel nozzle 52 from a lower end 38 of the inlet portion 34, then connecting the fuel tank fill hose 26 to the fuel nozzle 52, then extending a vent nozzle 54 from the inlet portion 34, then connecting the fuel tank vent hose 28 to the vent nozzle 54. Next, forming a single, substantially circular hole 24 in the deck 22 of sufficient diameter to pass the inlet portion 34, and yet small enough to preclude passage of the entire vented fuel filler 30, then inserting the inlet portion 34 through the deck hole 24 from beneath the deck 22. The next step is providing first 44 and second 46 grooves in an outer surface 42 of the inlet portion 34 adjacent an upper end 36 of the inlet portion 34, then terminating the first 44 and second 46 grooves at opposite ends 48. Next, providing first 104 and second 106 clamps, then extending each of the first 104 and second 106 clamps in an arc between opposite ends 108, then engaging the body first 44 and second 46 grooves with semicircular inner edges 110 of the first 104 and second 106 clamps respectively, then juxtaposing the opposite ends 108 of the first 104 and second 106 clamps with the ends 48 of the first 44 and second 46 grooves respectively, thereby preventing rotation of the vented fuel filler 30 in the deck hole 24, then fastening the first 104 and second 106 clamps to the deck 22.

Further steps comprise providing a cap 58, then inscribing a fuel type on a top surface 64 of the cap 58, then arraying a plurality of teeth 72 in an annular pattern on a bottom surface 66 of the cap 58, and facing the teeth 72 inward. Next, providing an insert 74, then projecting a plurality of teeth 94 outward from the insert 74, then receiving the insert teeth 94 in the cap teeth 72 with selective angular positioning, and then attaching the insert 74 to the cap 58. Finally, attaching the insert 74 threadably to the upper end 36 of the inlet portion 34, thereby covering the vented fuel filler 30, and then adjusting the angular positioning of the cap 58 on the insert 74 selectively, whereby the inscription 130 will be readable from a predetermined position.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. Details of the structure may be varied substantially without departing from the spirit of the invention and the exclusive use of all modifications that will come within the scope of the appended claims is reserved.

The embodiments of the invention in which an exclusive property or privilege is claimed are defined as follows:

1. A vented fuel filler for a boat, the boat having a hull and a deck with a single round hole to receive the filler, the boat having a fuel tank, a fuel tank fill hose communicating with the fuel tank, and a fuel tank vent hose communicating with the fuel tank, the vented fuel filler comprising:

a body, the body having an inlet portion, the inlet portion being a hollow cylinder extending between opposite upper and lower ends, the inlet portion having inner and outer surfaces, the inlet portion having first and second grooves in the outer surface adjacent the upper end, each one of the first and second grooves extending in an arc between opposite ends, the inlet portion having threads at the upper end, the body having a fuel nozzle attached to the inlet portion lower end, the fuel nozzle being adapted for connection to the fuel tank fill hose, the body having a vent nozzle attached to the inlet portion adjacent the lower end, the vent nozzle being adapted for connection to the fuel tank vent hose, the inlet portion communicating with the fuel nozzle and the vent nozzle;

a cover, the cover having a cap, the cap having a roof with a periphery, the roof having a top surface and a bottom surface, the cap having a skirt extending outward from the roof periphery, the cap having a boss centered on the roof bottom surface and extending downward therefrom, the cap having a plurality of teeth arranged annularly on the roof bottom surface, the teeth facing inward, the cover having an insert, the insert having a generally circular plate with a periphery, the plate having a top surface and a bottom surface, the plate having at least one vent hole therethrough for venting air, the insert having an annular wall extending downward from the plate bottom surface, the wall having threads adapted to engage the body inlet portion threads, the insert having a boss extending downward from the plate bottom surface, the boss having a hole therethrough adapted to receive the cap boss, the insert having a plurality of teeth projecting outward from the plate periphery, the insert teeth being adapted to be selectively received in the cap teeth, so that the cap is selectively angularly positioned on the insert, the plate having at least one knob projecting upward from the plate top surface, the cover having attaching means for attaching the insert to the cap, so that upon assembly of the insert into the cap, the insert teeth will be received in the cap teeth, the cap boss will be received in the insert boss hole, and the knob will provide a space between the cap roof bottom surface and the insert plate top surface, wherein vent air will be allowed to flow around the teeth, across the plate top surface, and through the plate vent hole;

sealing means for releasably sealing the cover to the body; and a first clamp and a second clamp, each one of the first and second clamps extending in an arc between opposite ends, each one of the first and second clamps having semicircular inner and outer edges, each one of the first and second clamps having at least one fastener hole therethrough, the first and second clamp inner edges being adapted to engage the body first and second grooves respectively, so that upon assembly of the vented fuel filler into the deck, the body inlet portion will be inserted in the deck hole from below, the first and second clamp inner edges will be inserted into the body first and second grooves respectively, and the first and second clamps will be fastened to the deck, whereby the vented fuel filler will be installed in the boat from below the deck.

2. The vented fuel filler of claim 1, wherein:

the cap boss includes a threaded hole centered therein; and the attaching means includes an attaching screw received in the cap boss threaded hole.

3. The vented fuel filler of claim 2, further comprising:

a link having a slot therethrough, the link being mounted on the cap boss with the attaching screw passing through the slot;

a safety wire extending between opposite ends, the safety wire having a ferrule attached to each end, one end of the safety wire passing through the slot, and the opposite end of the safety wire being slideably attached to the body; and a spring attached to the safety wire for retracting the safety wire when the cover is installed on the body.

4. The vented fuel filler of claim 1, wherein:

the insert includes an O-ring groove between the insert wall threads and the insert plate bottom surface;

the sealing means includes an O-ring received in the O-ring groove; and the inlet portion inner surface includes an O-ring seat at the upper end to receive the O-ring when the cover is installed on the body.

5. The vented fuel filler of claim 1, further comprising a gasket interposed between the first and second clamps and the deck, so as to seal the deck hole against water intrusion.

6. The vented fuel filler of claim 1, further comprising a grounding screw threadably attached to the body for electrically grounding the vented fuel filler.

7. A vented fuel filler for a boat, the boat having a hull and a deck with a single round hole to receive the filler, the boat having a fuel tank adapted for holding a predetermined type of fuel, a fuel tank fill hose communicating with the fuel tank, and a fuel tank vent hose communicating with the fuel tank, the vented fuel filler comprising:

a body, the body having an inlet portion, the inlet portion being a hollow cylinder extending between opposite upper and lower ends, the inlet portion having inner and outer surfaces, the inlet portion having first and second grooves in the outer surface adjacent the upper end, each one of the first and second grooves extending in an arc between opposite ends, the inlet portion having female threads on the inner surface at the upper end, the inlet portion inner surface having an O-ring seat at the upper end, the body having a fuel nozzle attached to the inlet portion lower end, the fuel nozzle being adapted for connection to the fuel tank fill hose, the body having a vent nozzle attached to the inlet portion adjacent the lower end, the vent nozzle being adapted for connection to the fuel tank vent hose, the inlet portion communicating with the fuel nozzle and the vent nozzle;

a cover, the cover having a cap, the cap having a roof with a periphery, the roof having a top surface and a bottom surface, the cap having an inscription on the roof top surface indicating the fuel type, the cap having a skirt extending outward from the roof periphery, the cap having a boss centered on the roof bottom surface and extending downward therefrom, the cap boss having a threaded hole centered therein, the cap having a plurality of teeth arranged annularly on the roof bottom surface, the teeth facing inward, the cover having an insert, the insert having a generally circular plate with a periphery, the plate having a top surface and a bottom surface, the plate having at least one vent hole therethrough for venting air, the insert having an annular wall extending downward from the plate bottom surface, the wall having male threads adapted to engage the body inlet portion threads, the insert having an O-ring groove between the threads and the plate bottom surface, the insert having a boss extending downward from the plate bottom surface, the boss having a hole therethrough adapted to receive the cap boss, the insert having a plurality of teeth projecting outward from the plate periphery, the insert teeth being selectively received in the cap teeth, so that the cap is selectively angularly positioned on the insert, whereby the inscription will be readable from a predetermined position, the plate having at least one knob projecting upward from the plate top surface, the cover having an attaching screw received in the cap boss threaded hole for attaching the insert to the cap, so that upon assembly of the insert into the cap, the insert teeth will be received in the cap teeth, the cap boss will be received in the insert boss hole, and the knob will provide a space between the cap roof bottom surface and the insert plate top surface, wherein vent air will be allowed to flow around the teeth, across the plate top surface, and through the plate vent hole;

an O-ring received in the O-ring groove for releasably sealing the cover to the body;

a first clamp and a second clamp, each one of the first and second clamps extending in an arc between opposite ends, each one of the first and second clamps having semicircular inner and outer edges, each one of the first and second clamps having at least one fastener hole therethrough, the first and second clamp inner edges being adapted to engage the body first and second grooves respectively, so that upon assembly of the vented fuel filler into the deck, the body inlet portion will be inserted in the deck hole from below, the first and second clamp inner edges will be inserted into the body first and second grooves respectively, and the first and second clamps will be fastened to the deck, whereby the vented fuel filler will be installed in the boat from below the deck; and a grounding screw threadably attached to the body for electrically grounding the vented fuel filler.

8. The vented fuel filler of claim 7, further comprising:

a link having a slot therethrough, the link being mounted on the cap boss with the attaching screw passing through the slot;

a safety wire extending between opposite ends, the safety wire having a ferrule attached to each end, one end of the safety wire passing through the slot, and the opposite end of the safety wire being slideably attached to the body; and a spring attached to the safety wire for retracting the safety wire when the cover is installed on the body.

9. The vented fuel filler of claim 7, further comprising a gasket interposed between the first and second clamps and the deck, so as to seal the deck hole against water intrusion.

10. A method of installing a vented fuel filler in a boat, the boat having a hull and a deck, the boat having a fuel tank, a fuel tank fill hose communicating with the fuel tank, and a fuel tank vent hose communicating with the fuel tank, the method comprising the steps of:

providing a vented fuel filler with an inlet portion of a predetermined diameter;

extending a fuel nozzle from the inlet portion;

extending a vent nozzle from the inlet portion;

forming a single, substantially circular hole in the deck of sufficient diameter to pass the inlet portion, and preclude passage of the entire vented fuel filler;

inserting the inlet portion through the deck hole from beneath the deck;

providing first and second grooves in an outer surface of the inlet portion adjacent an upper end of the inlet portion;

terminating the first and second grooves at opposite ends;

providing first and second clamps;

extending each of the first and second clamps in an arc between opposite ends;

engaging the body first and second grooves with semicircular inner edges of the first and second clamps respectively;

juxtaposing the opposite ends of the first and second clamps with the ends of the first and second grooves respectively, thereby preventing rotation of the vented fuel filler in the deck hole; and fastening the first and second clamps to the deck.

11. The method of claim 10, further comprising the steps of:

providing a cap;

inscribing a fuel type on a top surface of the cap;

arraying a plurality of teeth in an annular pattern on a bottom surface of the cap, and facing the teeth inward;

providing an insert;

projecting a plurality of teeth outward from the insert;

receiving the insert teeth in the cap teeth with selective angular positioning;

attaching the insert to the cap;

attaching the insert threadably to the upper end of the inlet portion, thereby covering the vented fuel filler; and adjusting the angular positioning of the cap on the insert selectively, whereby the inscription will be readable from a predetermined position.

12. A method of installing a vented fuel filler in a boat, the boat having a hull and a deck, the boat having a fuel tank, a fuel tank fill hose communicating with the fuel tank, and a fuel tank vent hose communicating with the fuel tank, the method comprising the steps of:

providing a vented fuel filler with an inlet portion of a predetermined diameter;

extending a fuel nozzle from a lower end of the inlet portion;

connecting the fuel tank fill hose to the fuel nozzle;

extending a vent nozzle from the inlet portion;

connecting the fuel tank vent hose to the vent nozzle;

forming a single, substantially circular hole in the deck of sufficient diameter to pass the inlet portion, and preclude passage of the entire vented fuel filler;

inserting the inlet portion through the deck hole from beneath the deck;

providing first and second grooves in an outer surface of the inlet portion adjacent an upper end of the inlet portion;

terminating the first and second grooves at opposite ends;

providing first and second clamps;

extending each of the first and second clamps in an arc between opposite ends;

engaging the body first and second grooves with semicircular inner edges of the first and second clamps respectively;

juxtaposing the opposite ends of the first and second clamps with the ends of the first and second grooves respectively, thereby preventing rotation of the vented fuel filler in the deck hole;

fastening the first and second clamps to the deck;

providing a cap;

inscribing a fuel type on a top surface of the cap;

arraying a plurality of teeth in an annular pattern on a bottom surface of the cap, and facing the teeth inward;

providing an insert;

projecting a plurality of teeth outward from the insert;

receiving the insert teeth in the cap teeth with selective angular positioning;

attaching the insert to the cap;

attaching the insert threadably to the upper end of the inlet portion, thereby covering the vented fuel filler; and adjusting the angular positioning of the cap on the insert selectively, whereby the inscription will be readable from a predetermined position.

* * * * *